US005131815A

United States Patent [19]

Yamaguchi et al.

[11] Patent Number: 5,131,815

[45] Date of Patent: Jul. 21, 1992

[54] ROTOR BLADE OF AXIAL-FLOW MACHINES

[75] Inventors: Nobuyuki Yamaguchi, Takasago; Mitsushige Goto, Nagasaki; Tsuneyoshi Mitsuhashi, Takasago, all of Japan

[73] Assignee: Mitsubishi Jukogyo Kabushiki Kaisha, Tokyo, Japan

[21] Appl. No.: 601,857

[22] Filed: Oct. 24, 1990

[30] Foreign Application Priority Data

Oct. 24, 1989 [JP] Japan ..... 1-274812

[51] Int. Cl.[5] ..... B63H 1/26

[52] U.S. Cl. ..... 416/223 A; 416/DIG. 2; 416/223 R; 416/242

[58] Field of Search ..... 416/223 A, DIG. 2, 219 R, 416/220 R, 242, 223 R

[56] References Cited

U.S. PATENT DOCUMENTS

| | | | |
|---|---|---|---|
| 4,585,395 | 4/1986 | Nourse et al. | 416/223 A |
| 4,682,935 | 7/1987 | Martin | 416/DIG. 2 |
| 5,035,578 | 7/1991 | Tran | 416/DIG. 2 |
| 5,044,885 | 9/1991 | Oddul et al. | 416/223 A |

FOREIGN PATENT DOCUMENTS

| | | | |
|---|---|---|---|
| 0074706 | 6/1977 | Japan | 416/223 A |
| 586841 | 4/1977 | Switzerland . | |
| 2151310 | 7/1985 | United Kingdom . | |
| 2164098 | 3/1986 | United Kingdom . | |

*Primary Examiner*—Thomas E. Denion
*Attorney, Agent, or Firm*—Wenderoth, Lind & Ponack

[57] ABSTRACT

The known rotor blade for use with axial-flow machines is improved. The improvement resides in a novel configuration of the blade body of the rotor blade. A leading edge of a tip end portion of the blade body is inclined forward (in the upstream direction of flow) and also advances in a direction of rotation, towards a tip end surface of the blade body. In the tip end portion between the tip end surface and a cross section displaced from the tip end surface towards the central portion of the blade body by ½ of a chord length of the tip end surface, the configuration of the leading edge of the tip end portion is such that an angle S of skew thereof over which the leading edge of the tip end portion advances in the direction of rotation and an effective skew amount $\Theta_s$ eff thereof of the angle over which the leading edge of the tip end portion is inclined forward in the upstream direction falls in a particular region in a graph of S vs. $\Theta_s$ eff delimited by 4 specific points determined through experiments.

5 Claims, 5 Drawing Sheets t
t/2
AIR FLOW

ROTOR BLADE OF AXIAL-FLOW MACHINES

BACKGROUND OF THE INVENTION

1. Field of the Invention

The present invention relates to rotor blades of axial-flow machines for transferring energy to fluid or for receiving energy from fluid, such as axial-flow blowers, axial-flow compressors, axial-flow pumps, axial-flow gas turbines, etc. (throughout this specification and claims, these machines will be generally referred to as "axial-flow machines").

2. Description of the Prior Art

At first, the structure of a rotor blade of an axial-flow machine in the prior art will be described with reference to FIG. 6. In FIG. 6(*a*), reference numeral 1 designates a blade body of a rotor blade, numeral 2 designates a platform (flange portion), and numeral 3 designates a screw portion. The rotor blade body 1 is fixedly secured to a hub (not shown) by means of the platform 2 and the screw portion 3. In lieu of the screw portion 3, a dovetail could ployed. The respective cross-sectional profiles taken along cross sections A-F perpendicular to the radial direction of the hub are shown in FIG. 6(*c*), and the points denoted by numeral 5 in this figure are centers of the respective cross-sectional profiles. In addition, reference character Y designates the direction of an airflow, and reference character R designates the direction of rotation of the blade body 1.

The blade body 1 of a rotor blade in the prior art has the centers 5 of the respective cross-sectional profiles aligned in the same straight line. Numeral 6 designates a centroid of centers 5 which form a straight line aligned above the same radial location on the hub. The reason why the respective centers 5 are aligned above the same radial location on the hub, is so that unnecessary stress will not be generated by a centrifugal force acting upon the rotor blade. If the centers of FIG. 5 were not aligned in a straight line, a moment acting in directions other than the radial direction of the hub would be generated by the centrifugal force, and a bending stress would act upon the rotor blade. However, if the centers 5 are aligned above the same radial location on the hub, then theoretically only a tensile stress can act upon the rotor blade. (It is to be noted that, in practice, a bending stress caused by compressed gas as well as a torsion stress on the respective cross-sectional profiles would be also generated.) In other words, the structure of the rotor blade in the prior art was designed only from the view point of mechanical strength.

As described above, in a rotor blade of, for instance, an axial-flow compressor in the prior art, the structure of the rotor blade was designed only from a view point of mechanical strength, and so the respective centers 5 of the cross-sectional profiles of the blade body 1 were aligned above the same radial location on the hub. However, at the tip end portion of the blade body 1, that is, at the portion of the blade body closest to the inner surface of a casing, turbulent complicated flows are formed as the result of a drift by centrifugal forces at a boundary layer along the inner surface of the casing and a boundary layer along the blade surface, or as the result of an accumulation of secondary flows between the respective blade bodies. Hence, fluid having low energy is liable to stagnate, resulting in a decreased action of the blade body 1, and a pressure loss of the flow at the tip end portion that is larger than that of the flow at the central portion of the blade body 1 (a principal flow). Consequently, the efficiency of the rotor blade is low.

SUMMARY OF THE INVENTION

It is therefore one object of the present invention to provide an improved rotor blade for use with axial-flow machines, in which the aforementioned problems of the rotor blade in the prior art are resolved.

A more specific object of the present invention is to provide a rotor blade for use with axial-flow machines, in which a large pressure loss at the tip end portion of a blade body is reduced, whereby the efficiency of the rotor blade is enhanced.

According to one feature of the present invention, there is provided a rotor blade of an axial-flow machine comprising a blade body in which a leading edge of a tip end portion is inclined forward in the upstream direction of the airflow and also extends in a direction of rotation, and the configuration of the leading edge of the tip end portion between a tip end surface of the blade body and a cross section thereof displaced from the tip end surface towards the central portion by ½ of the chord length of the tip end surface is such that an angle S of skew over which the leading edge of the tip end portion advances in the direction of rotation, and an effective skew amount $\theta_s$eff of the angle over which the leading edge of the tip end portion is inclined forward fall in the region delimited by the following 4 points A, B, c and D:

| | A | B | C | D |
|---|---|---|---|---|
| S | 90° | 50° | 50° | 90° |
| $\Theta_s$ eff | 4° | 12° | 21° | 27° |

In the rotor blade of axial-flow machines according to the present invention, in order to reduce a large pressure loss especially at the tip end portion of the blade body so as to improve the efficiency of the rotor blade, the configuration of the tip end portion of the blade member was determined experimentally. The leading edge of the tip end portion of the blade member is inclined forward in the upstream direction and also extends in a direction of rotation to degrees which fall within the above-specified region. Therefore, fluid having low energy which is liable to stagnate at the tip end portion of the blade body will instead be forced to flow in the downstream direction without stagnating at the tip end portion.

The above-mentioned and other objects, features and advantages of the present invention will become more apparent by referring to the following description of preferred embodiments of the invention taken in conjunction with the accompanying drawings.

BRIEF DESCRIPTION OF THE DRAWINGS

In the accompanying drawings:

FIG. 1(*b*) is a plan view of the same;

FIG. 1(*c*) is a diagram including a plurality of cross-sectional views of the same taken at six different positions;

FIG. 2(*b*) is a schematic view of a rotary blade of an axial-flow compressor in the prior art;

FIG. 6(*b*) is a plan view of the same; and

FIG. 6(*c*) is a diagram including a plurality of cross-sectional views of the same;

DETAILED DESCRIPTION OF THE PREFERRED EMBODIMENTS

Figure 1A:
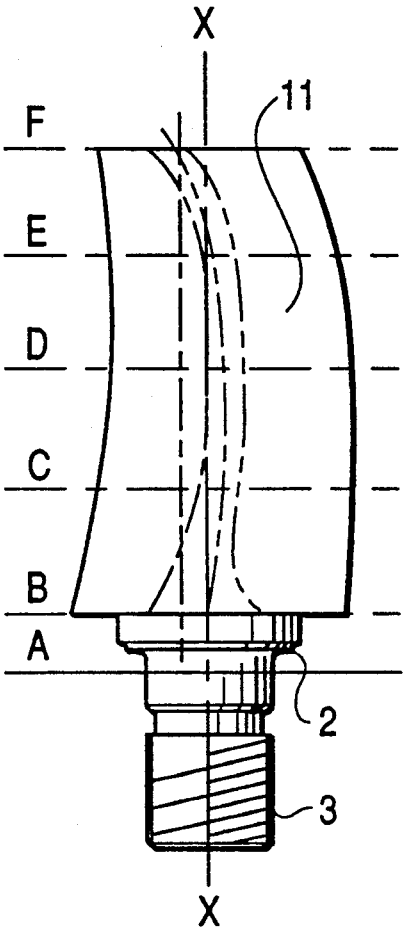
FIG. 1(*a*) is a side view of a rotor blade of an axial-flow compressor according to one preferred embodiment of the present invention.
Figure 1C:
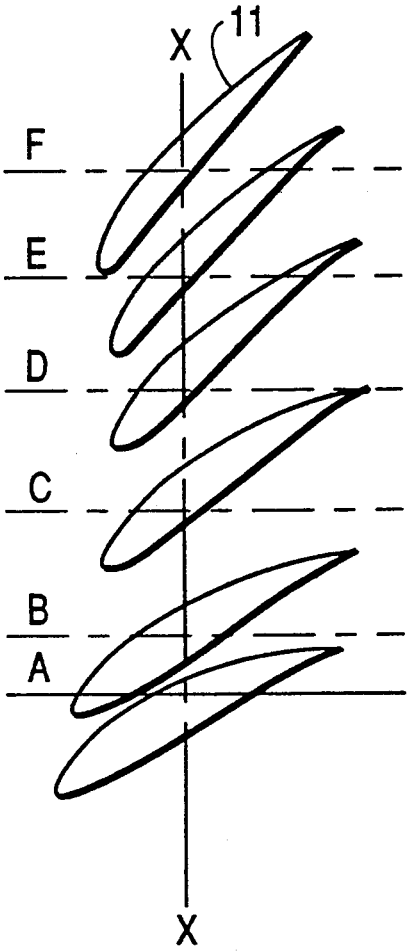
Figure 1B:
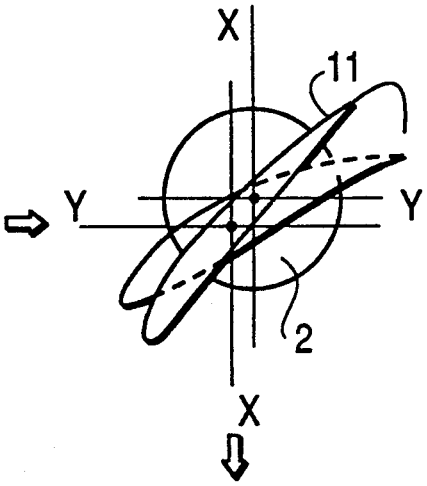

Now, one preferred embodiment of the present invention will be described with reference to FIGS. 1 to 4. Referring to FIG. 1, a rotor blade of an axial-flow compressor according to the present invention is designed in such manner that fluid having low energy which is liable to stagnate at a tip end portion of a blade body 11 will be forced to flow downstream in order to improve the efficiency of the rotor blade by reducing a high pressure loss, especially at the tip end portion of the blade body 11. As shown in this figure, the leading edge of the tip end portion of the blade body 11 is tilted forwards in the direction of the longitudinal axis of the axial-flow compressor, that is, is tilted forwards in the upstream direction of an airflow Y, and also is skewed in the direction of rotation R of the blade body 11 relative to that of the base portion of the blade body 11. More particularly, in FIG. 1(*a*) reference numeral 2 designates a platform (flange, portion) of the blade body 11, and numeral 3 designates a screw portion for fixing the blade body to a rotor shaft. In addition, as shown in FIGS. 1(*b*) and 1(*c*), the tip end portion of the blade body 11 projects forward as gradually bending from the central portion. It is to be noted that while a lower portion of the blade body 11 also projects forward, this is for the purpose of balancing moments about a blade axis X-X produced by centrifugal forces at the respective cross-sectional profiles of the blade body, and not for the purpose of especially improving the efficiency of the rotor blade.

Figure 2A:
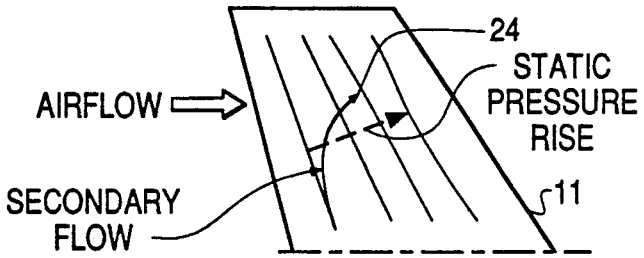
FIG. 2(*a*) is a schematic view of the same showing the forward inclination of the lead edge of the blade body.
Figure 2B:
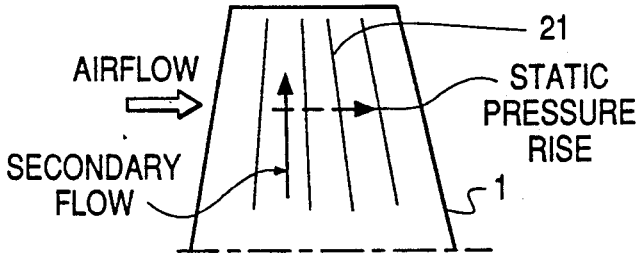
FIG. 2(b) PRIOR ART

Referring to FIG. 2 which is a schematic view of rotor blades, reference numeral 1 designates a blade body of a rotor blade in the prior art, numerals 21 and 24 designate equi-pressure lines of static pressure on the blade surface, dotted line arrows indicate the direction of rise of the static pressure, and bold line arrows indicate the direction in which a boundary layer adhered to the blade surface is pushed towards the outside (tip end portion) in the radial direction of the axial flow machine. Although the boundary layer is pushed towards the outside in the radial direction, in the case of the rotary blade in the prior art, as shown in FIG. 2(*b*), equi-pressure lines 21 are directed nearly in the radial direction. Hence, the outward movement of the secondary flow of the boundary layer is not prevented. Consequently, the secondary flow is directed towards the tip end portion of the blade body 1, and the boundary layer is liable to stagnate there. Whereas, in the case of the rotor blade according to the present invention, the tip end portion of the blade body 11 extends forward, and the equi-pressure lines 24 have a distribution titled forward towards the tip end portion of the blade body 11. Therefore, the outward movement of the secondary flow of the boundary layer adhered to the blade is prevented by the increase in static pressure towards the outside, and is directed downstream. Therefore, fluid having low energy does not stagnate at the tip end portion of the blade body 11 but is pushed towards the downstream portion of the blade body 11 such that the operational state at the tip end portion of the blade body 11 is improved compared to the prior art, and the efficiency of the rotor blade is enhanced.

Figure 3:
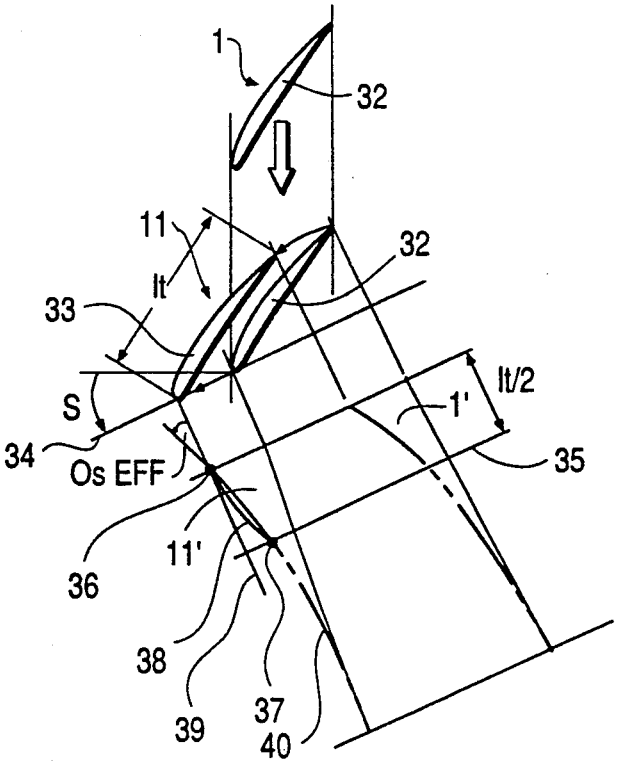
FIG. 3 is a diagrammatic view of rotor blades of axial-flow compressors according to the aforementioned preferred embodiment and in the prior art.

In FIG. 3, a white bold arrow indicates a direction of rotation of rotor blades. Reference numeral 33 designates the position of the tip end surface of the rotor blade of the present invention, in plan. The tip end surface 33 of this rotor blade is displaced with respect to a tip end surface 32 of a rotor blade in the prior art, relative to the direction of the longitudinal axis of the axial-flow compressor as well as to the direction of rotation thereof. The direction of the relative displacement is represented by an angle S taken with respect to the longitudinal axis. This direction of relative displacement is a skew direction, the angle S being the angle formed by the amount of relative displacement the direction in which the leading edge of the tip end portion of the blade member 11 advances forward, and numeral 34 designates the skew direction line. A skew reference surface refers to a plane passing through this skew direction line 34, and extending nearly along the direction of height of the blade body 11. Reference numerals 1′ and 11′ designate projections of the respective rotor blades onto this skew reference surface shown as lying in the plane of the sheet of FIG. 3. The blade body 1 in the prior art which does not have a forwardly projecting tip end is depicted by solid lines, and the blade body 11 of the rotor blade according to the present invention is depicted by double-dot chain lines.

The symbol $l_t$ represents a chord length of the tip end portion of the rotor blade according to the present invention. In order to define an amount of skew, the tip end portion of the blade body between the tip end surface of the rotor blade and a cross section 35 displaced from the tip end surface towards the central portion by $l_t/2$ will be considered because within this range, the blade body is influenced by the secondary flow. A point 37 is the position of the leading edge of the cross-sectional profile of cross section 35 of the rotor blade according to the present invention, as taken on the skew reference surface. A point 36 indicates the position of the leading edge of the tip end surface 33 of the rotor blade according to the present invention, as taken likewise on the skew reference surface. The angle formed between a straight line connecting the both points 36 and 37, i.e. an effective skew line 38, and a straight line 39 perpendicular to the longitudinal axis of the axial-flow compressor on the skew reference surface, represents the "effective skew amount $\Theta_s$ eff". Although a leading edge 40 representing the positions of the leading edges of each of the respective cross-sectional profiles does not always form a straight line in practice, the thus defined effective skew amount $\Theta_s$ eff is an average angle over which the tip end portion tilts forward in the upstream direction of flow. The degree of influence of the secondary flow can be mostly investigated on the basis of the two parameters, the angle S delimited by the skew direction and the effective skew amount $\Theta_s$ eff defined on the skew reference surface.

Figure 4:
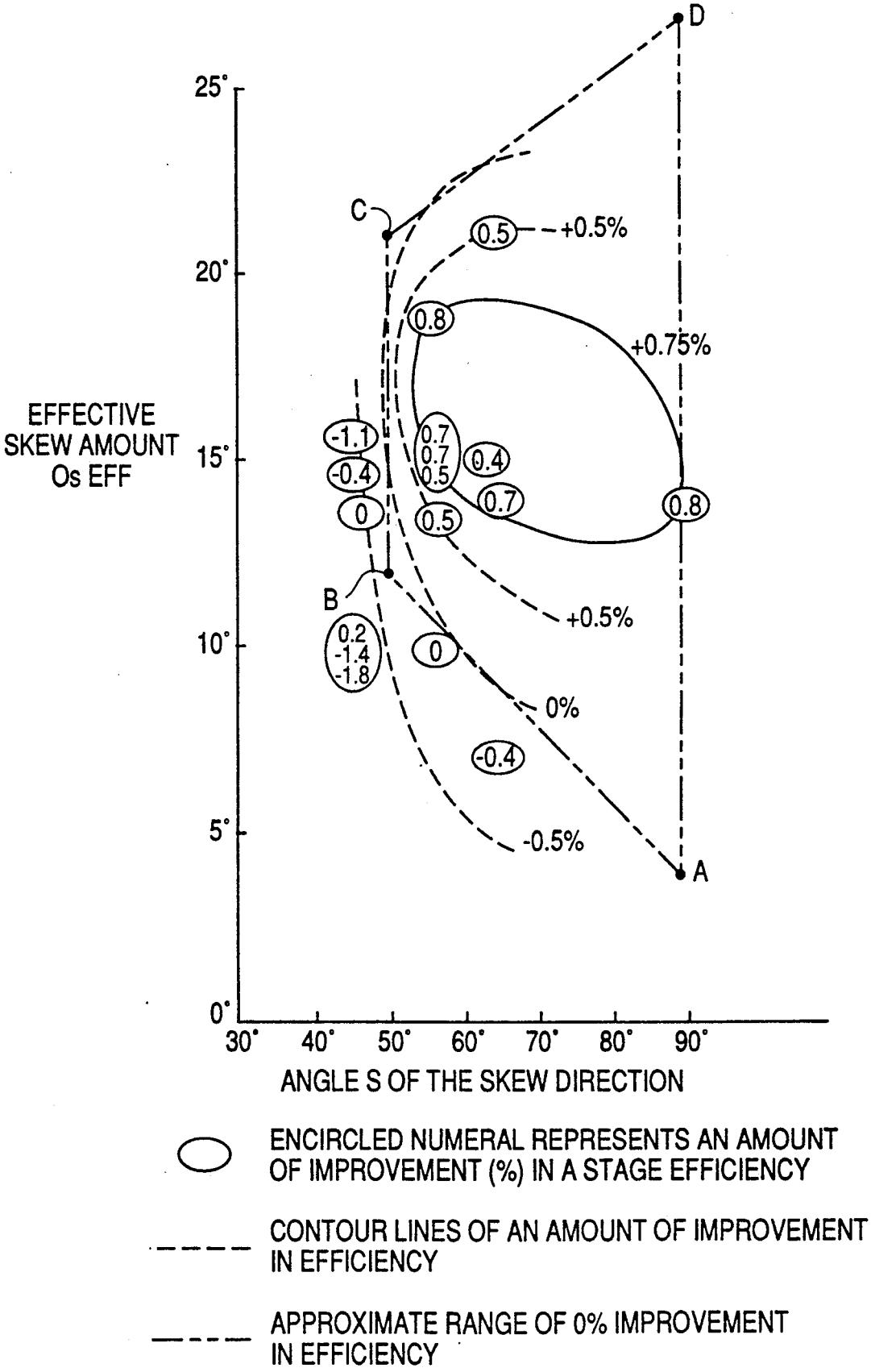
FIG. 4 is a diagram showing the region of an angle S of the skew direction and an effective skew amount $\theta_s$ eff of a rotor blade of an axial-flow compressor according to the above-mentioned preferred embodiment.

FIG. 4 is a diagram of data obtained from experiments conducted with respect to the rotor blade according to the present invention. In this diagram, the angle S of the skew direction is plotted along the abscissa, the effective skew amount is plotted along the ordinate, an amount of improvement in a stage peak efficiency is written in % at each point plotted, and regions of general tendency are depicted by contour lines passing through similar amounts of improvement in efficiency. In this figure, the regions where the amount of improvement in efficiency is 0% or more, define the parameters of a rotor blade 11 which has been improved according to the present invention. And straight lines inscribing the contours passing through amounts of improvement of 0% or more extend between the four points A, B, C and D.

| | A | B | C | C |
|---|---|---|---|---|
| S | 90° | 50° | 50° | 90° |
| $\Theta_s$ eff | 4° | 12° | 21° | 27° |

Figures 5A, 5B, 5C:
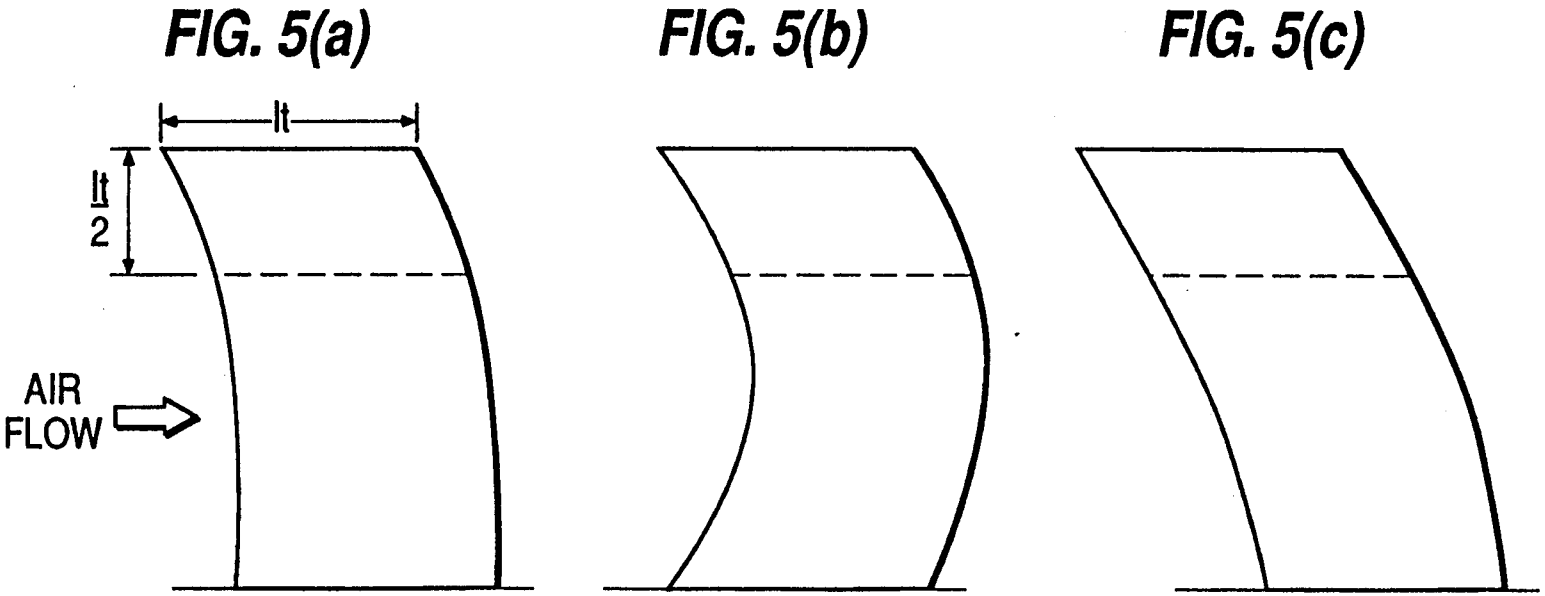
FIGS. 5(*a*)–5(*c*) are side views of rotor blades of axial-flow compressors according to other preferred embodiments of the present invention.
Figure 6A:
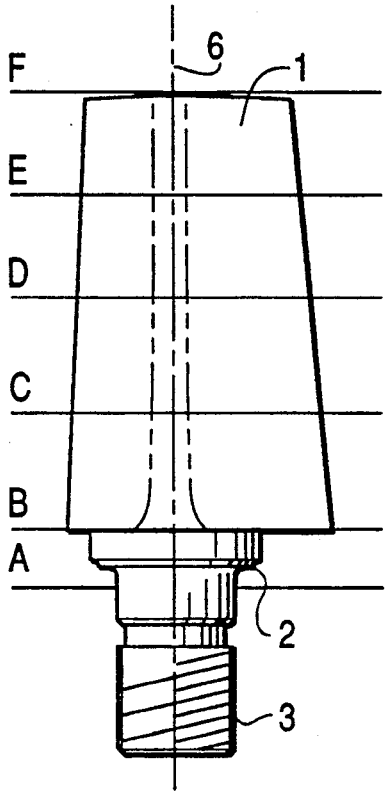
FIG. 6(a) PRIOR ART
FIG. 6(*a*) is a side view of a rotary blade of an axial-flow compressor in the prior art.
Figure 6C:
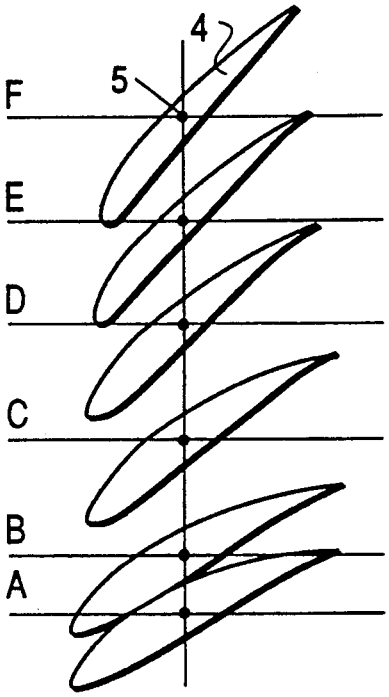
FIG. 6(c) PRIOR ART
Figure 6B:
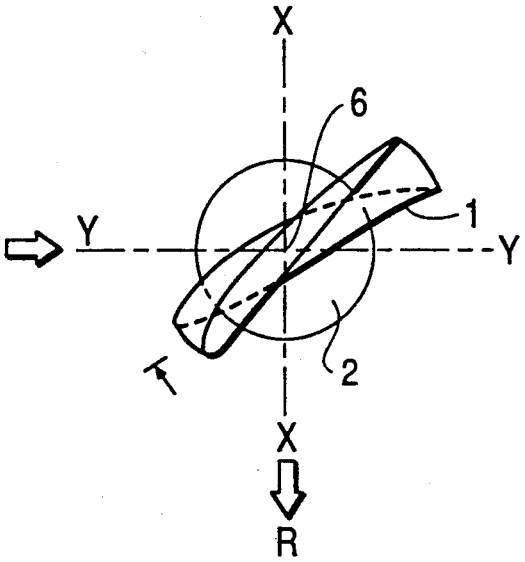
FIG. 6(b) PRIOR ART

Accordingly, in a rotor blade having improved efficiency according tot heinvention, the configuration of the leading edge of the tip end portion betweeen the tip end surface of the rotor blade and a cross section thereof displaced from the tip end surface towards the central portion by $l_t/2$ is such that the above-described angle S of the skew direction and the effective skew amount $\Theta_s$ eff are within the region delimited by the aforementioned four points A, B, C and D. It is to be noted that the leading edge and the trailing edge of the blade body 11 in the range extending from the central portion displaced from the tip end surface by $l_t/2$ or more to the hub are designed so as to smoothly continue the configuration of that portion of the leading edges in the influencing range. For instance, the edges could be of an upright as shown in FIG. 5(*a*), of a reverse tilt type as shown in FIG. 5(*b*) or of a constant tilt type as shown in FIG. 5(*c*0. In general, a stage effeciency $\eta$ of an axial-flow compressor exceeds 90%; accordingly the amount of improvment in efficiency $\Delta\eta=0.8\%$ offered by the rotor blade of the present invention is as much as $(0.8/10)\times 100=8\%$; that is, 8% of the loss experienced by the prior art has been reduced, and this is considered to be very large.

It is to be noted that the rotor blade according to the present invention should not be limited to only the above-described axial-flow compressor, but it is applicable to machines other than an axial-flow compressor, such as, for instance axial-flow blowers, axial-flow pumps and gas turbines.

As will be obvious from the detailed description above, the rotor blade for use with axial-flow machines according to the present invention is designed so that fluid having low energy, which is liable to stagnate at the tip end portion of the blade body, is instead forced to flow to downstream without stagnating, whereby the efficiency of the rotor blade is comparatively high.

While a principle of the present invention has been described above in connection with preferred embodiments of the invention, it is intended that all matter contained in the above description and illustrated in the accompanying drawings shall be interpreted to be illustrative of and not as a limitation on the scope of the invention.

What is claimed:

1. A rotor blade for use with axial-flow machines, said rotor blade comprising a blade body having a leading edge of a tip end portion thereof which is inclined forward and also extends in a direction of rotation towards a tip end surface of the blade body, and wherein the configuration of the leading edge of said tip end portion between said tip end surface and a cross section of the blade body displaced from said tip end surface towards a central portion of the blade body by ½ of the chord length of said tip end surface is such that an angle S of skew thereof over which the leading edge of said tip end portion advances in the direction of rotation, and an effective skew angle $\Theta_s$ eff over which the leading edge of said tip end portion is inclined forward fall within a graphed region of angle S vs. $\Theta_s$ eff delimited by the following 4 points A, B, C and D:

| | A | B | C | D |
|---|---|---|---|---|
| S | 90° | 50° | 50° | 90° |
| $\theta_s$ eff | 4° | 12° | 21° | 27° |

2. A rotor blade for use with axial-flow machines as claimed in claim 1, wherein a portion of the blade body, located between an end thereof opposite said tip end surface and said cross section displaced form the tip end surface of the rotor blade towards the central portion by ½ of the chord length of said tip end portion, is of an upright type in which the leading edge and the trailing edge thereof extend in a direction nearly perpendicular to the plane of said cross section.

3. A rotor blade for use with axial-flow machines as claimed in claim 1, wherein a portion of the blade body, located between an end thereof opposite said tip end surface and said cross section displaced from the tip end surface of the rotor blade towards the central portion by ½ of the chord length of said tip end portion, is of a reverse tilting in which the leading edge and the trailing edge thereof first incline back and then incline forward with respect to a direction extending from said end thereof toward said cross section.

4. A rotor blade for use with axial-flow machines as claimed in claim 1, wherein a portion of the blade body, located between an end thereof opposite said tip end surface and said cross section displaced from the tip end surface of the rotor blade towards the central portion by ½ of the chord length of said tip end portion, is of a constant tilt type in which the leading edge and the trailing edge are inclined only forward with respect to a direction extending from said end thereof to said cross section.

5. In a gas turbine having a casing, a shaft mounted for rotation within the casing, and a plurality of rotor blades fixed to said shaft and extending radially therefrom toward said casing, the improvement wherein each of said rotor blades comprises a blade body having a leading edge of a tip end portion thereof which is inclined forward in the upstream direction of gas flow through the turbine and also extends in a direction of rotation towards a tip end surface of the blade body, and wherein the configuration of the leading edge of said tip end portion between said tip end surface and a cross section of the blade body displaced from said tip end surface towards a central portion of the blade body by ½ of the chord length of said tip end surface is such that an angle S of skew thereof over which the leading edge of said tip end portion advances in the direction of rotation, and an effective skew angle $\Theta_s$ eff over which the leading edge of said tip end portion is inclined forward in the upstream direction of gas flow through the turbine fall within a graphed region of angle S vs. $\Theta_s$ eff delimited by the following 4 points A, B, C and D:

| | A | B | C | D |
|---|---|---|---|---|
| S | 90° | 50° | 50° | 90° |
| $\theta_s$ eff | 4° | 12° | 21° | 27° |

* * * * *

UNITED STATES PATENT AND TRADEMARK OFFICE

CERTIFICATE OF CORRECTION

PATENT NO. : 5,131,815

DATED : July 21, 1992

INVENTOR(S) : Nobuyuki YAMAGUCHI

It is certified that error appears in the above-identified patent and that said Letters Patent is hereby corrected as shown below:

In the Drawings:

In FIG. 3 and FIG. 4, "Os EFF" has been changed to --θs EFF--.

Signed and Sealed this

Nineteenth Day of October, 1993

Bruce Lehman

*Attest:*

BRUCE LEHMAN

*Attesting Officer*

*Commissioner of Patents and Trademarks*